United States Patent [19]

Raganato et al.

[11] 4,189,455

[45] Feb. 19, 1980

[54] PROCESS FOR THE MANUFACTURE OF DISCONTINUOUS FIBRILS

[75] Inventors: Carlo Raganato, Castiglioncello, Italy; Georges Voituron, Vilvoorde, Belgium

[73] Assignee: Solvay & Cie., Brussels, Belgium

[21] Appl. No.: 277,032

[22] Filed: Aug. 1, 1972

[30] Foreign Application Priority Data

Aug. 6, 1971 [LU] Luxembourg ..... 63680

[51] Int. Cl.[2] ..... B29D 23/08

[52] U.S. Cl. ..... 264/12; 264/140; 264/141; 425/7

[58] Field of Search ..... 264/DIG. 75, 210 F, 264/12, 176, 14, 140, 141, 167, 168, 21.0 F; 159/47 R, 16; 425/7

[56] References Cited

U.S. PATENT DOCUMENTS

| | | | |
|---|---|---|---|
| 2,297,726 | 10/1942 | Stephanoff | 34/10 |
| 2,357,392 | 9/1944 | Francis | 425/83 |
| 2,483,406 | 10/1949 | Francis | 425/83 |
| 2,831,845 | 4/1958 | Biddle et al. | 260/94.9 P |
| 2,967,327 | 1/1961 | Ladisch | 65/5 |
| 2,988,469 | 6/1961 | Watson | 425/83 |
| 3,015,127 | 1/1962 | Stalego | 264/DIG. 75 |
| 3,042,970 | 7/1962 | Terenzi | 264/14 |
| 3,110,642 | 11/1963 | Harrington et al. | 264/176 F |
| 3,227,794 | 1/1966 | Anderson et al. | 264/205 |
| 3,246,683 | 4/1966 | Yap et al. | 159/47 R |
| 3,306,342 | 2/1967 | Salvo et al. | 159/47 R |
| 3,309,734 | 3/1967 | Bynum et al. | 264/176 Z |
| 3,342,921 | 9/1967 | Brandige et al. | 264/200 |
| 3,386,488 | 6/1968 | Ratzsch et al. | 264/5 |
| 3,450,184 | 6/1969 | Schnoving et al. | 159/16 |
| 3,544,078 | 12/1970 | Stupakis | 264/12 |
| 3,549,732 | 12/1970 | Rice | 264/143 |
| 3,562,369 | 2/1971 | Chopra et al. | 264/168 |
| 3,576,931 | 4/1971 | Chopra et al. | 264/210 F |
| 3,645,085 | 2/1972 | Rassart | 57/140 |
| 3,719,648 | 3/1973 | Frielink | 264/143 |
| 3,730,918 | 5/1973 | Teti et al. | 260/33.4 R |
| 3,740,383 | 6/1973 | Gabellieri et al. | 260/94.9 GD |
| 3,743,272 | 7/1973 | Nowotny et al. | 264/69 |
| 3,746,681 | 7/1973 | McClain | 260/75 T |
| 3,770,856 | 11/1973 | Ueki et al. | 264/20 S |
| 3,774,387 | 11/1973 | Woodell | 161/172 |
| 3,808,091 | 4/1974 | Aoki et al. | 162/157 R |
| 3,883,630 | 5/1975 | Raganato | 264/204 |
| 3,885,014 | 5/1975 | Fukada et al. | 264/176 F |

FOREIGN PATENT DOCUMENTS

| | | | |
|---|---|---|---|
| 1350931 | 12/1964 | France | 264/176 F |

*Primary Examiner*—Jay H. Woo
*Attorney, Agent, or Firm*—Spencer & Kaye

[57] ABSTRACT

A continuous fibrillated structure, formed by the abrupt pressure release of a two-phase liquid mixture of polymer and solvent at elevated temperature and pressure so as to cause the instantaneous vaporization of the solvent, is shredded by a stream of fluid directed transversely against the continuous fibrillated structure at the moment of its formation.

22 Claims, 3 Drawing Figures

PROCESS FOR THE MANUFACTURE OF DISCONTINUOUS FIBRILS

BACKGROUND OF THE INVENTION

The present invention relates to a process for the manufacture of discontinuous fibrils by the abrupt release of pressure on a two-phase liquid mixture of molten polymer and solvent which is under elevated pressure and at elevated temperature.

It is well known that one can produce continuous fibrillated structures or rovings by such processes. For example, in U.S. Pat. No. 2,372,695, issued May 15, 1940, and assigned to Celanese Corp. of America there is a description of the production of a downy mass formed of very fine filaments connected with one another by bringing about an abrupt pressure release, through an appropriate orifice, of a solution of a cellulose derivative which is at elevated temperature and pressure.

According to Belgian Pat. No. 568,524 of June 11, 1958, in the name of E. I. Du Pont de Nemours, continuous structures consisting of a multitude of fibrillous strands or sections, which come together and separate at random intervals to form a "unit fibrillous plexus", are obtained by extruding a solution of synthetic polymer, which is at a temperature higher than the normal boiling point of the solvent and under autogenous pressure or under a higher pressure, through an orifice of suitable shape into a zone of lower pressure.

The fibrillated structures obtained according to the processes described above take the form of continuous rovings. Moreover, as is stated in Belgian Pat. No. 568,524, these structures are produced at a very high speed, which may reach as high as 13,700 m/min, which makes it impossible to cut them up by mechanical means.

The subsequent processing of these continuous rovings produced at very high speed is very difficult. Moreover, for a large number of applications, it is essential to use the fibrillated products in a shredded form, that is to say in the form of discontinuous structures of relatively short length, for example of the order of a few millimeters.

That is why, as can be seen from French Pat. No. 1,246,379 of Nov. 17, 1959, in the name of E. I. du Pont de Nemours, it is necessary to reduce the length of the continuous fibrillated rovings by a treatment in a grinding apparatus. This treatment is harmful to the physical qualities of fibrillated structures and calls for a supplementary operation which necessitates tying up large amounts of capital and requires a considerable amount of power.

It is apparent that a process of the type described above, but leading to the direct production of short fibrils, could, in numerous cases, permit a more economical and easier use of the products obtained and improve their quality.

SUMMARY OF THE INVENTION

It is the object of the present invention to provide a process which avoids the above-described disadvantages.

The present invention relates to a process for the manufacture of discontinuous fibrils by the abrupt pressure release of a two-phase liquid mixture of molten polymer and solvent, which is at elevated temperature and pressure, so as to bring about the instantaneous vaporization of the solvent and to tend to form a continuous fibrillated structure. According to the invention, the continuous fibrillated structure produced by the above-described process is shredded at the moment of its formation by a transverse stream of fluid.

By the designation "discontinuous fibrils" is meant elongated fibrillated structures consisting of very slender filaments, of a thickness of the order of a micron, connected with one another so as to form a three-dimensional network. These fibrils which are of a fluffy appearance generally have an elongated shape. Their length varies from 1 mm to about 5 cm and their diameter from about 0.01 to 5 mm. The specific surface area of these products is greater than 1 $m^2/g$. These fibrils are particularly suitable for production, by the usual methods, of non-woven textiles and synthetic papers.

The process according to the invention may be carried out by using any polymer which is suitable for spinning.

Among the polymers which can be used one may mention the polyolefins such as polyethylene, polypropylene, ethylene/propylene copolymers, polyisobutylene, etc., polyamides, polyesters, polyurethanes, polycarbonates, vinyl polymers such as polyvinyl chloride, which may also be postchlorinated, polyvinyl fluoride, acrylic polymers such as the homopolymers and copolymers of acrylonitrile, etc. This list is by way of example and is not restrictive.

Nevertheless, the applicants prefer to use crystallizable polymers whose rate of crystallinity measured by X-ray diffraction is at least 10% and preferably at least 20%, because the stretch to which these polymers are subjected, as a result of the action of vapors released during the abrupt pressure release, imparts to them an oriented structure which results in good mechanical properties.

Among these polymers, the polyolefins such as high-density polyethylene, isotactic polypropylene and isotactic poly-4-methylpentene-1 lead to the best results.

The solvent is preferably chosen according to the polymer used as well as the following criteria. The solvent must not dissolve more than 50 g/liter and preferably not more than 10 g/liter of polymer under normal conditions of temperature and pressure (20° C. and 1 atmosphere). Moreover, it must possess at normal pressure a boiling point which is more than 20° C. and preferably more than 40° C. lower than the melting or softening point of the polymer used. Furthermore, it must permit the formation of a two-phase liquid mixture under operational conditions just prior to the abrupt pressure release.

Among the solvents which can be used one may mention the aliphatic hydrocarbons such as pentane, hexane, heptane, octane and their homologues and isomers, the alicyclic hydrocarbons such as cyclohexane, the aromatic hydrocarbons such as benzene, toluene etc., the halogenated solvents such as the chlorofluoromethanes, methylene chloride, ethyl chloride, etc., the alcohols, ketones, esters and ethers.

The applicants define below what is meant by the expression "two-phase liquid mixture".

When one subjects a mixture of suitable solvent and polymer, with a suitable concentration of polymer, to very elevated temperature and pressure, one observes that the mixture takes the form of a single homogeneous liquid phase. If, then, while maintaining all the other conditions constant, one gradually reduces the pressure, one observes that, as from a certain pressure onwards, which varies according to the case, the solution of polymer becomes turbid because of the establishment of a system of two liquid phases consisting of a continuous liquid phase which is poor in polymer and in which there is dispersed, in the form of droplets, a second liquid phase which is rich in polymer. The value of the pressure at which this phenomenon makes its appearance may be determined experimentally.

In the process according to the invention, it is therefore advisable to choose the pressure of the mixture, which is subjected to the abrupt pressure release, in such a way that it is present in the form of a two-phase liquid mixture. The same applies to the concentration of polymer and the temperature.

In practice one may prepare a solution with a single liquid phase at a higher pressure than that at which the formation of a two-phase liquid mixture takes place and then carry out a sufficient prior release of pressure to bring about the establishment of the system with two liquid phases.

The temperature of the two-phase liquid mixture subjected to abrupt pressure release must be such that the latent heat stored by the solvent and the molten polymer is sufficient to bring about the complete vaporization of the solvent during the abrupt pressure release. This temperature must not, however, exceed a maximum value otherwise the quantity of heat consumed by the vaporization of the solvent would be insufficient to bring about the solidification of the polymer. Furthermore, it must enable the apparatus to operate at a pressure at which the formation of the two-phase liquid mixture takes place. Finally, the temperature must be lower than the critical temperature of the solvent. Generally speaking, the temperature of the mixture is between 100° and 300° C. and preferably between 125° and 250° C.

The concentration of polymer in the mixture used is also selected so as to permit a two-phase liquid mixture to be obtained. It may vary from 1 to 500 g/kg of mixture. However, the applicants prefer to use mixtures containing from 10 to 300 g of polymer per kg of mixture and preferably 50 to 200 g/kg.

For each particular polymer therefore it is necessary to choose a solvent complying with the criteria defined above and then to determine the concentration of polymer, the pressure and the temperature of the mixture which is subjected to instantaneous pressure release. These parameters are therefore chosen not only so as to give a two-phase liquid mixture, but also so that the solvent vaporizes instantaneously and completely during the abrupt pressure release. These conditions are the same as those imposed on two-phase liquid mixtures used according to the prior art to manufacture continuous fibrillated rovings.

The two-phase liquid mixtures are subjected to an abrupt pressure release, that is to say their pressure is brought to a value close to atmospheric pressure, preferably to a pressure lower than 3 kg/cm$^2$ absolute, within a very short period of time, preferably less than 1 second. This pressure release may be brought about by passing the mixture through any device which is capable of creating high load losses, such as a diaphragm, a Venturi or a valve. However, it is preferable to use dies whose cylindrical orifices have a diameter of between 0.1 and 3 mm and preferably between 0.3 and 1 millimeter and a length/diameter ratio of between 0.1 and 10 and preferably between 0.5 and 2.

When one uses the dies described above without the use of a transversely directed fluid stream according to the invention, one obtains continuous fibrillated rovings which come out at high speed along the axis of the orifice of the die.

It is obvious that the two-phase liquid mixture used may also contain other usual additives for polymers such as stabilizers to the action of heat and light, reinforcing agents, fillers, pigments, antistatic agents, nucleation agents, etc.

Any fluid may be used for shredding the continuous fibrillated structure produced by the abrupt release of the two-phase liquid mixture. Thus it may be a gas, a vapor or a liquid. However, it is preferred to use gases and vapors for reasons of convenience.

It is also obvious that this fluid must not exert any harmful action on the continuous fibrillated structure produced by the abrupt pressure release of the mixture. In particular, the use of a fluid which exerts a solvent or swelling action on the polymer used at ambient temperature must be ruled out.

As has been stated above, the fluid used may be of any desired kind, provided it is inert in relation to the polymer used. In particular, the applicants have obtained excellent results when this fluid was nitrogen, water vapor, water or an organic liquid. The applicants have also found that it is possible to use as fluid the solvent used to make the two-phase liquid mixture.

The speed of the current of fluid at the time of its impact on the fibrillated structure to be shredded may vary within wide limits. Thus, when the fluid is in liquid form, it is sufficient for its speed at this moment to be higher than 1 meter per second and preferably higher than 10 meters per second.

On the other hand, when the fluid is in the form of a vapor or gas, its speed is preferably higher than 50 meters/sec and may reach supersonic values. Naturally, the rate of flow of fluid and the geometry of the inlet device for this fluid must be selected so that the impact covers the entire fibrillated structure which is formed and gives discontinuous fibrils of the desired length.

The temperature of the fluid is not critical. It is preferably between ambient temperature and the melting point or softening point of the polymer used. The angle formed between the direction of outflow of the fibrillated structure and the direction of the fluid at the moment of impact must be between 75° and 180° and is preferably between 80° and 150°. The best results are obtained with an angle which lies between 90° and 135°.

The preferential zone for the impact of the fluid on the continuous fibrillated structure may be determined by examining the shape adopted by a continuous fibrillated structure produced by the abrupt release of the two-phase liquid mixture and this will be discussed in more detail below.

In order to facilitate the collection of the fibrils formed by the process according to the invention, the applicants prefer the fluid which shreds the continuous fibrillated structure to be directed vertically downwardly while the solution of polymer is spun horizontally or obliquely upwardly. However, it is obvious that this choice is only fixed by considerations of a practical nature and that the directions of the fluid and of the solution being spun may be any desired directions provided that the condition of relative orientation of these two streams is complied with.

The device which can be used to carry out the process according to the invention may be any such device provided the requirements defined above are complied with.

An advantageous mode of embodiment of the invention is that in which the fluid moves in a pipe into which open one or more orifices through which the two-phase liquid mixture is passed so as to bring about its abrupt pressure release. The pipe may be of circular cross section or any other cross section. The fluid may be set in motion by any known means, for example by means of a turbine or, if it is gaseous, by pressure release in a device causing a load loss. The pipe is connected at one end to the source of fluid; its other end is open so as to permit the recovery of the discontinuous fibrils produced.

The preferred mode of embodiment of the invention is that in which the fluid moves in a pipe of variable cross section along which the fluid passes successively through a convergent zone in which the cross section decreases and then a constricted zone in which the cross section is minimum and finally a divergent zone, the cross section of which increases, but the latter is not essential. The fluid is introduced into the pipe at a pressure which is sufficient to cause its acceleration during its passage in the zones mentioned. In this form of embodiment, the orifices through which one passes the two-phase liquid mixture preferably open into the restricted zone or possibly into the convergent zone.

In these modes of embodiment of the invention, the outlet of the orifices through which one passes the two-phase liquid mixture is not located at the level of the wall of the pipe, so that the impact of the stream of gaseous fluid is not produced in the zone where the solvent is still not yet completely vaporized but at the points where its effect is most favorable. The outlet of the orifices is located set back from the level of the wall by a distance the optimum value of which may be determined easily by experimental methods. Generally speaking, this distance is greater than 1 millimeter. In this way, the outlet of the orifice is located at the bottom of a cavity, the cross section of which may be of any desired size but is preferably sufficient so as not to inhibit the expansion of the fibrillated structure. This cavity may be of variable cross section. At the level of the wall it is preferably between 10 and 100 times that of the orifice.

By way of example, described below are two types of devices which give complete satisfaction. However, it is understood that these descriptions which are given purely by way of illustration do not in any way limit the scope of the present invention. It is, in fact, quite evident that one may make numerous modifications to the devices which are described without thereby falling outside the scope or the spirit of the present invention.

DESCRIPTION OF THE PREFERRED EMBODIMENTS

Figure 1:
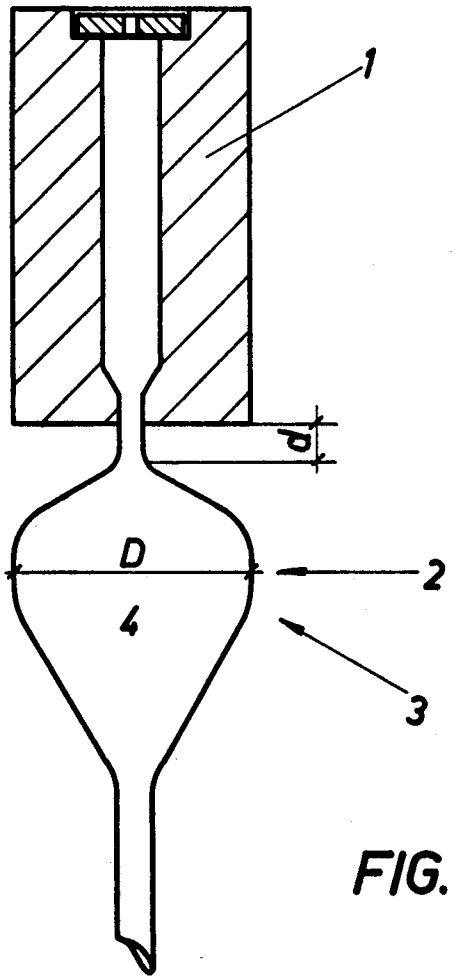
FIG. 1 is a diagrammatic view of a continuous fibrillated structure produced at a die.

Before discussing devices which can be used in conjunction with the invention, it will be helpful to consider the shape adopted by a continuous fibrillated structure produced by the abrupt release of a two-phase liquid mixture and attention is directed to FIG. 1.

As can be seen in this figure, the mixture leaving the die 1 has a diameter which is more or less equal to that of the outlet orifice and it holds this diameter over a distance d which is relatively short, before it opens out as a result of the action of the abrupt vaporization of the solvent, until it achieves a diameter D which may be as much as 20 times the diameter of the die. Then the gases formed by the vaporization of the solvent escape from the fibrillated structure, causing it to contract so that it finally assumes the form of a continuous roving.

The distance d, separating the outlet orifice of the die from the place where the fibrillated structure commences to open out, varies according to the nature of the solvent and of the polymer used and according to the conditions of operation.

The applicants have found that it is preferable for the impact zone of the fluid on the fibrillated structure to be located at the point of its formation, that is to say before the place where the latter is contracted so as to form the continuous roving. Preferably this impact zone is situated at the place where the fibrillated structure reaches its maximum expansion.

This preferential zone is shown in FIG. 1 by the arrows 2 and 3, symbolizing the preferential limiting axes of injection of the fluid which has to shred the fibrillated structure as and when it is formed.

Figure 2:
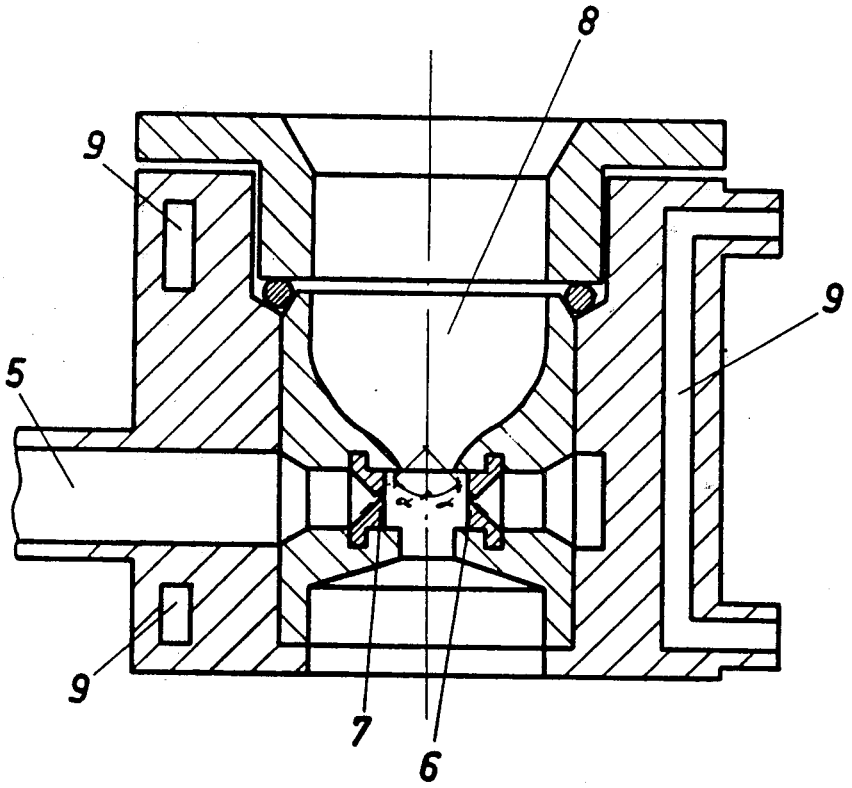
FIG. 2 is a sectional view of a first device for carrying out the invention.

Attention is now directed to FIG. 2 which shows one device which can be used in conjunction with the invention.

As can be seen from FIG. 2, the device contains a pipe 5 for feeding in the two-phase liquid mixture which is under the required conditions of pressure and temperature. This pipe 5 is connected to two opposite abrupt release dies 6 and 7, the diameter and length of the orifices 6' and 7' of which is 0.6 mm. These two orifices are directed upwardly at an angle $\alpha$ of 45° to the vertical.

These two dies 6 and 7 open onto a pipe 8 in the form of a Venturi, the converging part of which is connected to a source (not shown in the drawing) of fluid under pressure aimed at shredding the fibrillated structure produced by the abrupt pressure release of the two-phase liquid mixture.

The dies open into a restricted section generally indicated at 8' of the Venturi of the pipe 8, this section having a length and a diameter of 9 mm.

As can be seen in FIG. 2, the ends of the dies 6 and 7 are set back 2 mm in relation to the wall of the pipe 8 at the restricted section 8', this being done in order that the stream of fluid coming through pipe 8 meets the continuous fribrillated structures to be shredded in the zone where these reach their maximum expansion as explained in conjunction with FIG. 1.

Using this die, the applicants have also found that when one has reached regular operation, it is possible to partially and even completely close the upper part of the pipe 8 and thus reduce and even suppress the supply of fluid and continue to obtain shredded fibrils of good quality. In this case in fact the vaporized solvent of the two-phase liquid mixture accumulates in the upper part of the pipe 8 and creates shock waves which reinforce the action of the fluid used to shred the fibrillated structure. In certain cases the rate of flow of solvent vapor is sufficient alone to obtain the effect desired. In the latter case of particularly economical operation, it is therefore the solvent of the two-phase liquid mixture which constitutes the fluid which shreds the fibrillated structure produced.

As can be seen from FIG. 2, the control of the temperature of the device may be provided by a heat exchange jacket 9.

Figure 3:
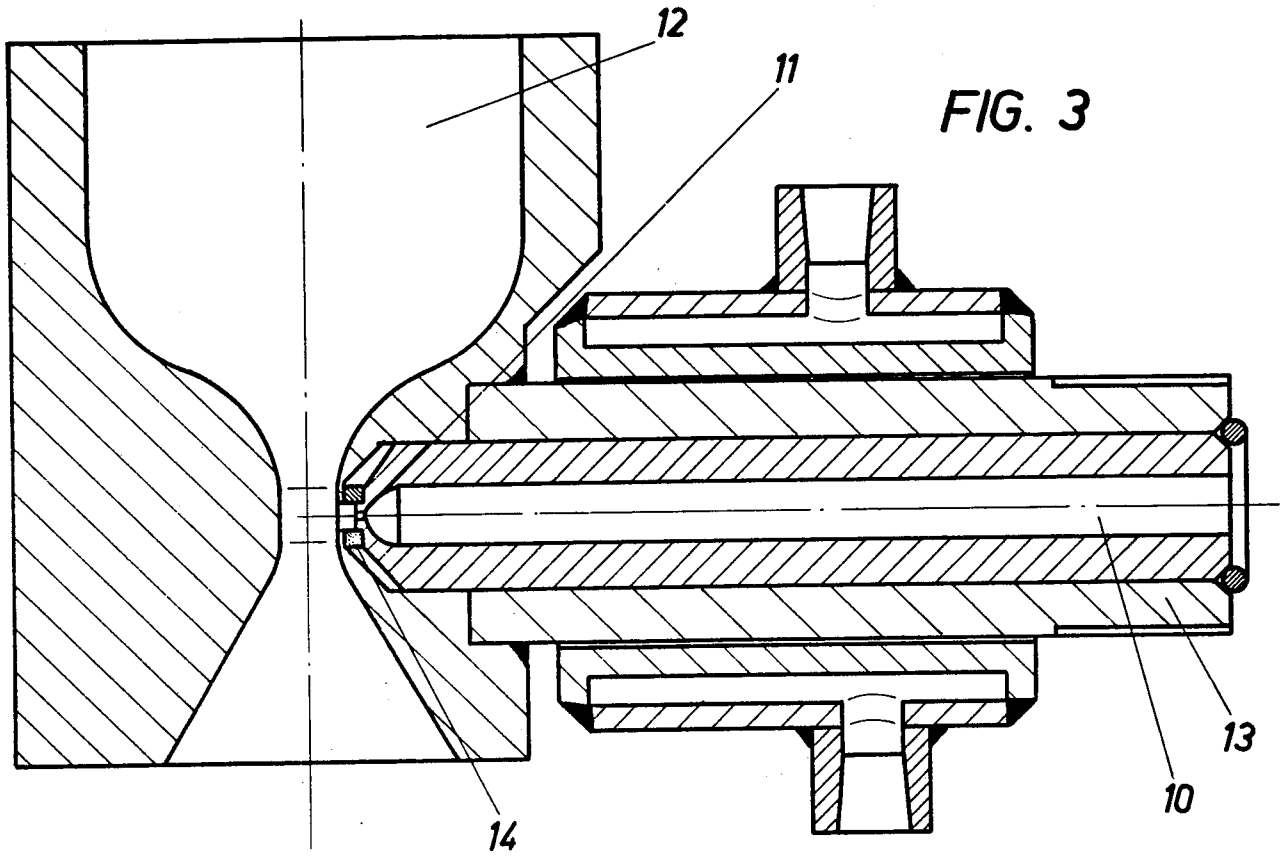
FIG. 3 is a sectional view of a second device for carrying out the invention.
Figure 2:
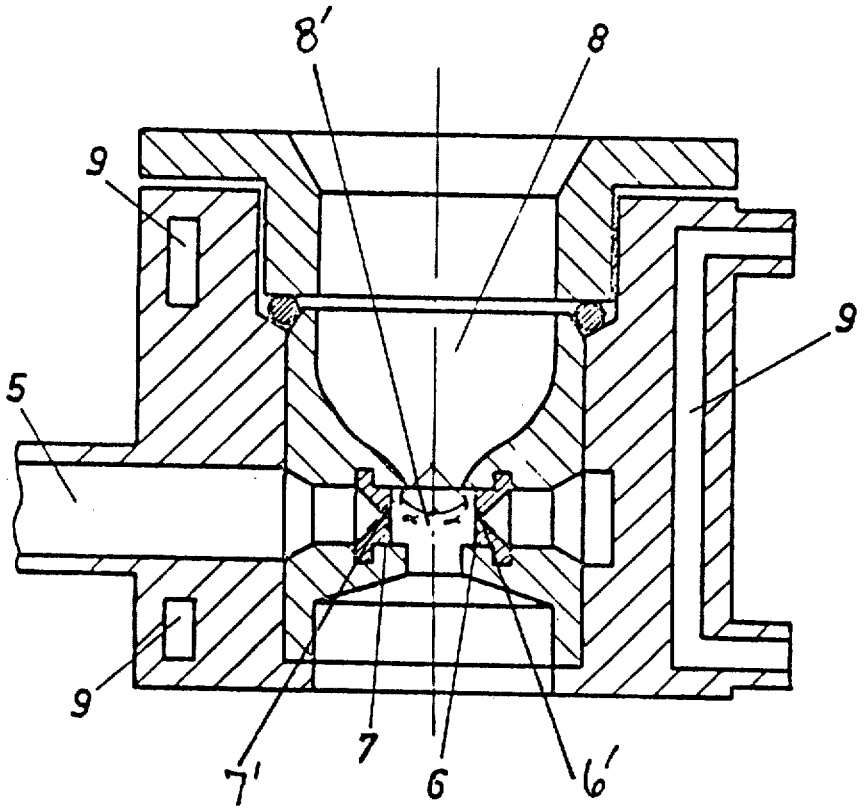
Figure 3:
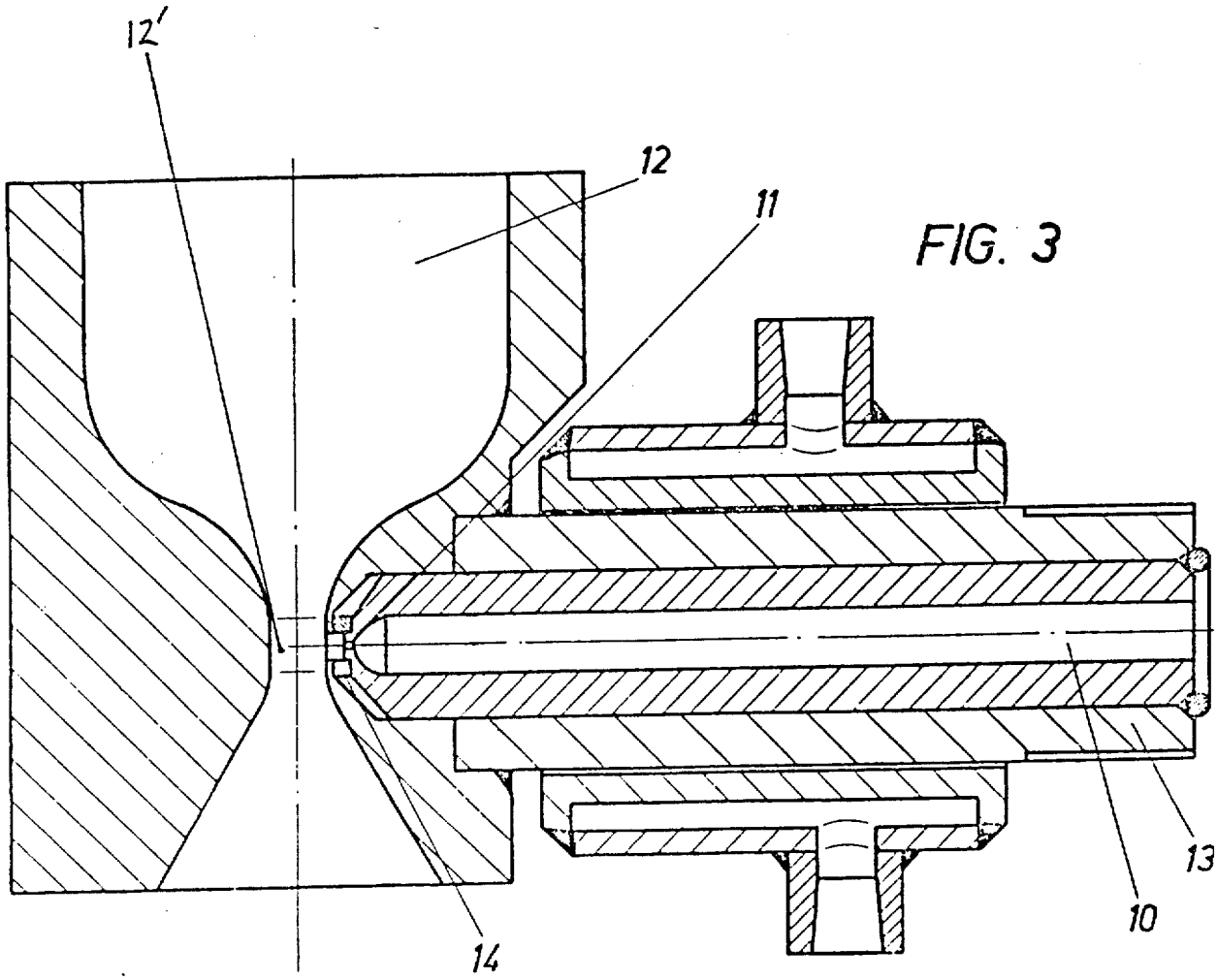

The device shown in FIG. 3 is of the same type as that which has just been described. However, the pipe 10 for feeding in the two-phase liquid mixture is only provided with one pressure release die 11 directed horizontally. THe pipe 12 for the inlet of the fluid also has the shape of a Venturi and die 11 opens into the restricted section 12' of the Venturi. The setback of the end of the die 11 in relation to the wall of the pipe 12 may be adjusted by moving the pipe 10 in its sleeve 13 by the use of shims 14 so as to cause the impact to take place in the most expanded part of the fibrillated structure.

The process according to the present invention is also explained by the examples of practical embodiments which follow. However, it is understood that these examples are given purely by way of illustration and do not in any way restrict the scope of the present invention.

EXAMPLE 1

The device shown in FIG. 2 is used.

Through the pipe 5 one continuously releases a two-phase liquid mixture of 13% by weight of ELTEX 54003 (high-density polyethylene produced by Solvay & Cie., Brussels, Belgium) and hexane of technical quality "polymerization grade" which is under a pressure of 66 kg/cm$^2$ and at a temperature of 190° C.

Through the pipe 8 one passes at the same time a stream of saturated water vapor at a gauge pressure of 3.9 kg/cm$^2$. The rate of flow is approximately 135 kgs/hr.

The rate of flow of mixture of polyethylene and hexane is approximately 16.5 kg/hr of polyethylene.

This results in fibrils which have a length of 10 mm and have a specific surface area of 13 m$^2$/g. These fibrils are particularly suitable for the production of unwoven textiles and synthetic papers.

EXAMPLE 2

A device of the type shown in FIG. 3 is used, in which the die 11 of the pipe 10:

- has a diameter of 0.7 mm and a length of 1 mm;
- is directed at an angle of 45° upwardly;
- is set back by 3 mm in relation to the wall of the restricted section of the pipe 12, this section having a diameter of 10 mm.

Through the pipe 10 is continuously released a two-phase liquid mixture of 8% of ELTEX 54 001 (high-density polyethylene produced by Solvay & Cie., Brussels, Belgium) and hexane of technical grade. This mixture is at a pressure 60 kg/cm$^2$ and a temperature of 190° C.

Through the pipe 12 is injected simultaneously saturated hexane of technical grade at a gauge pressure of 3.2 kg/cm$^2$. The rate of flow is approximately 300 kgs/hr.

The rate of flow of mixture of polyethylene and hexane is approximately 9 kgs/hr of polyethylene.

In this way it is possible to obtain fibrils with a length of 10 to 20 mm and having a specific surface area of 10.5 m$^2$/g.

EXAMPLE 3

There is produced a mixture containing 70% by weight of ELTEX A 409 (high-density polyethylene produced by Solvay & Cie.) and 30% by weight of PROFAX 6501 (polypropylene produced by HERCULES). This mixture is placed into solution in technical grade hexane at a concentration of 200 g of polymer per kg of solution, the solution being brought to a temperature of 200° C. and to a pressure of 70 kg/cm$^2$. This solution which is present in the form of a two-phase mixture is injected into the pipe 10 of the die described in Example 2 at a flow rate of 30 kg of polymer per hour.

Through the pipe 12 there is simultaneously injected saturated water vapor at a pressure of 5 kg/cm$^2$, the flow rate being of the order of 200 kg/h.

This results in fibrils having a length of 5–15 mm and a specific surface area of 7 m$^2$/g, the rate of production being 30 kg/hour.

EXAMPLE 4

Use is made of the die described in Example 2.

Through the pipe 10 there is continuously released a two-phase liquid mixture of technical grade hexane and polypropylene having a density of 0.907 kg/dm$^3$ the latter being in a concentration of 50 g/kg of solution. This mixture is at a pressure of 40 kg/cm$^2$ and at a temperature of 215° C. The flow rate is of the order of 9 kg of polypropylene per hour.

Through the pipe 12 there is simultaneously injected saturated water vapor at a relative pressure of 4 kg/cm$^2$. The flow rate of vapor is of the order of 100 kg/h.

There is thus obtained fibrils having a length of 3 mm and a specific surface area of 10 m$^2$/g, at a production rate of 9 kg/h.

It will be understood that the above description of the present invention is susceptible to various modifications, changes and adaptations and the same are intended to be comprehended within the meaning and range of equivalents of the appended claims.

We claim:

1. In a process for the manufacture of discontinuous fibrils by the abrupt pressure release of a liquid mixture of molten polymer and solvent which is at a temperature and pressure such as to be in the form of a system of two phases consisting of a continuous liquid phase which is poor in polymer and in which is dispersed a second liquid phase which is rich in polymer, the abrupt pressure release being adapted to bring about the instantaneous vaporization of the solvent and the solidification of said polymer to form a continuous fibrillated structure, the improvement which comprises shredding the continuous fibrillated structure so produced, at the moment of its formation, by directing a stream of fluid transversely against such structure.

2. A process as defined in claim 1 wherein said fluid used to shred the fibrillated structure is a gas.

3. A process as defined in claim 2 wherein said gas is nitrogen.

4. A process as defined in claim 1 wherein said fluid used to shred the fibrillated structure is a vapor.

5. A process as defined in claim 4 wherein said vapor is water vapor.

6. A process as defined in claim 4 wherein said vapor is the vapor of an organic solvent.

7. A process as defined in claim 1 wherein said fluid used to shred the fibrillated structure is a liquid.

8. A process as defined in claim 7 wherein said liquid is water.

9. A process as defined in claim 7 wherein said liquid is an organic solvent.

10. A process as defined in claim 1 wherein said fluid used to shred the fibrillated structure is identical with the solvent used to make the two-phase mixture with the polymer.

11. A process as defined in claim 1 wherein said fluid used to shred the fibrillated structure is the volatile constituent of the two-phase mixture vaporized by the abrupt pressure release.

12. A process as defined in claim 1 wherein said fluid used to shred the fibrillated structure is driven at a speed higher than 1 m/sec.

13. A process as defined in claim 1 wherein said fluid used to shred the fibrillated structure is in the gaseous state and is driven at a speed higher than 50 m/sec.

14. A process as defined in claim 1 wherein the angle between th direction of movement of the fibrillated structure and the direction of the stream of fluid at the moment of impact is between 75° and 180°.

15. A process as defined in claim 1 wherein the fibrillated structure contracts after its moment of formation to tend to form a continuous roving and said stream of fluid is directed against the fibrillated structure before it so contracts.

16. A process as defined in claim 15 wherein the fibrillated structure expands at the moment of its formation and said stream of fluid is directed against the fibrillated structure at the zone where the latter reaches its maximum expansion.

17. A process as defined in claim 1 wherein there is a pipe through which said stream of fluid flows, the pipe having a wall and defining an orifice in the wall and the abrupt pressure release of the two-phase liquid mixture takes place through the orifice.

18. A process as defined in claim 17 wherein the pipe has a convergent zone and a restricted zone.

19. A process as defined in claim 18 wherein the orifice in which the abrupt pressure release of the two-phase liquid mixture takes place opens into the restricted zone in the pipe.

20. A process as defined in claim 17 wherein the orifice, in which the abrupt pressure release of the two-phase liquid mixture takes place, has an outlet which is set back in relation to the wall of the pipe.

21. A process as defined in claim 1 wherein the polymer is selected from the group consisting of polyolefins, polyamides, polyesters, polyurethanes, polycarbonates, vinyl and acrylic polymers.

22. A process as defined in claim 1 wherein the discontinuous fibrils have a length of 1 to 20 mm.

* * * * *

UNITED STATES PATENT AND TRADEMARK OFFICE

CERTIFICATE OF CORRECTION

PATENT NO. : 4,189,455 Page 1 of 3

DATED : February 19, 1980

INVENTOR(S) : Carlo Raganato et al.

It is certified that error appears in the above—identified patent and that said Letters Patent is hereby corrected as shown below:

Figures 2 and 3 of the drawing should appear as shown on the attached sheets.

Signed and Sealed this

*Sixteenth* Day of *June 1981*

[SEAL]

*Attest:*

RENE D. TEGTMEYER

*Attesting Officer*

*Acting Commissioner of Patents and Trademarks*